United States Patent [19]

Atakkaan

[11] 4,420,202

[45] Dec. 13, 1983

[54] PLURAL PHASE CABLE COUPLERS

[75] Inventor: Namik O. Atakkaan, Bluefield, W. Va.

[73] Assignee: Pemco Corporation, Bluefield, W. Va.

[21] Appl. No.: 301,149

[22] Filed: Sep. 10, 1981

[51] Int. Cl.[3] ..... H01R 4/66

[52] U.S. Cl. ..... 339/14 R; 339/60 M; 339/143 C

[58] Field of Search ..... 174/73 R, 88; 339/143 C, 60 R, 60 M, 111, 143 R, 14 R

[56] References Cited

U.S. PATENT DOCUMENTS

| | | | |
|---|---|---|---|
| 3,509,518 | 4/1970 | Phillips | 339/143 C X |
| 3,517,113 | 6/1970 | Ono et al. | 174/73 R X |
| 3,932,933 | 1/1976 | Broad | 339/143 C X |
| 4,074,926 | 2/1978 | Broad | 339/60 R |

*Primary Examiner*—Eugene F. Desmond

*Attorney, Agent, or Firm*—Mason, Fenwick & Lawrence

[57] ABSTRACT

A cable coupler is disclosed for interconnecting a first plurality of plural-phase high voltage cables with a second plurality of plural-phase high voltage cables. The first plurality of cables is coupled to a like number of female terminals, whereas the second plurality of cables is connected to a like number of male terminals adapted to matingly contact the female terminals. The female terminals are adapted to be mounted within a female housing by a mounting means illustratively taking the form of a disc with openings spaced from each other to receive the female terminals. Similarly, there is included a male housing having a similar disc for mounting the male terminals in a spaced relationship with each other and in an aligned relationship with the female terminals. The mounting means and in particular the discs are comprised of a material whose conductivity is selected to be sufficiently high to establish a conductive path therethrough to a ground, whereby if a fault-producing voltage is applied to any one of the male or female terminals that a path will be readily provided from that terminal to ground, thus substantially reducing the occurrence of a phase-to-phase fault. In a further aspect of this invention, each high voltage cable is connected to its male or female terminal, the terminal being disposed within an insulator tube having an opening for receiving the terminal and a cylindrical portion defining a recess for receiving an end of its cable. A plug member made of a resilient insulating material and having a central opening for receiving its cable, and a stress cone made of a resilient insulating material and having a central opening for receiving its cable, are disposed by a pressure plate that abuts against the stress cone and forces it under mechanical pressure against the plug member, whereby an intimate, substantially air space free-relationship is achieved between the insulator tube, the plug member, the stress cone and the terminal.

6 Claims, 9 Drawing Figures

10
18
20
22
24
26
28
30
32
21
2
4
5
22a
22b
22c
12a
12b
12c
31
34
36
33
40
42
44
47
48
52
54
56
57
58
62
64
68
82
83
84
110a
122
127a
140
141
143
165
167
183
188
182
200
210a
369
439
469

10
21
26
42
84
86a
82
83
87
86b
88a
18
12a
12b
15a
14a
13a
12c
14c
86c
88c
113
100a
127a
165
84
40
122
110a
124
15c
13c
13b
11
112
110c
85
329
127a
125c
18
44
46
50
54
143
110b
64
85
369
371
439
469
222
20
210a
137a
140
52
224
20
210c
200a
188a
182
183
68
62
47
210b
28
429
130

PLURAL PHASE CABLE COUPLERS

DESCRIPTION

Background of the Prior Art

This invention relates to electrical cable couplers of the type used to interconnect sections of high voltage electrical cables to each other or to electrical equipment. More particularly, the invention relates to an electrical cable coupler which is especially adapted to interconnect the three phase conductors of a shielded cable or cables of the type commonly used in mining applications. Still more particularly, the invention relates to a cable coupler which greatly reduces the hazard of phase-to-phase faults.

It is well known that couplers of high voltage shielded cables present problems relating to the formation of corona and high concentration of electrical stress areas. Cable couplers by nature necessitate the stripping of the cable's outer conductive layers as well as a portion of the conductor insulation for connection to an electrical contact or connector for ultimate connection with another contact or connector of another permanently joined or releasably coupled cable. Many methods of cable terminations have been developed employing various types of termination adaptors having special conductor connectors, conductive inserts for termination adaptors, semiconductive shielding by means of coating or taping, etc., all aimed at redistribution of electrical stresses formed at the cable termination and thereby reducing the chances of corona formation and eventual breakdown of the insulation at the point of termination.

Many attempts have been made to eliminate as much as poslsible localized air pockets or voids anywhere along the cable terminus so as to reduce changes of the development of corona, that is, the ionization of air or gas entrapped within or between the elements making up the cable termination, thereby initiating a discharge which will eventually break down the termination insulation causing failure. A side effect of the production of ozone is the breakdown of the dielectric materials of the cable coupler. Further as the insulating material deteriorates, there is a greater likelihood of discharge between the elements of the cable coupler resulting eventually in cable failure. By redistribution of the electrical stresses developed at the cable coupler, high stresses can be effectively reduced to a level where the corona discharge stays at normal specified margin. This marginal level may be referred to as the corona extinction level, that is, the voltage level below which the corona becomes negligible, i.e. under the three pico coulomb level. In actual practice, corona may be experienced during a voltage fluctuation resulting from a transient surge or fault condition.

Cable couplers in the past have always been designed with the objective of increasing the dielectric thickness of the insulation material adjacent to the point where the cable shielding over the insulated conductor is actually terminated. By this new design, the dielectric buildup is in the form of a stress cone and by providing an extension to the cable shielding, stress has been reduced by redistributing the electrical stress concentration, that is, the concentration of the electrical flux field at the coupler to reduce the corona discharge and resulting dielectric failure of the cable. Thus, a divergent potential gradient is introduced at the dielectric buildup area. The shield, in such cases, is effectively extended to the stress cone.

The dielectric buildup was originally provided by means of a multiple layer of dielectric tape which was hand-wrapped on the cable. Also, self-bonding tape and different types of insulating gels and epoxies were used in an attempt to make the tape wrappings airtight. Since these enlarged dielectric areas are generally done by hand in the field, it is virtually impossible to produce a completely airtight, no-void coupler with multiple layers of wrapping tape, since the construction of the coupler depends largely upon workmanship and experience of the individual constructing the cable coupler.

Premolded stress relief cones have since come into existence to eliminate problems brought about by multiple layer tape wrappings and further reduce the possibility of constructing a cable coupler with undesirable voids or air pockets which are most frequently present at surface irregularities along various dielectric layers.

In the mining industry, both surface and underground, it is necessary to transmit large amounts of electrical power, usually over long distances, to supply the power requirements of the mining equipment. The most economical and efficient way of accomplishing this is at high voltages, with transformers located near the points of use, which, in turn, reduces the high voltages to operating voltages needed for equipment. Generally, transmission potentials as high as 15,000 volts for underground mining and 25,000 volts in surface mining with currents as high as 500 amps are used. Power is usually transmitted through a flexible, three phase cable. Due to the high potentials, the three phase conductors of the three phase cable are individually shielded and overall wrapped with a concentric, fine wire or metallic tape or braid. These electrically conductive shields are maintained at ground potential and serve several safety functions. Since each shield is concentric relative to each phase conductor, it evenly distributes electrostatic stress radially through the insulation which surrounds each phase conductor. The shield likewise confines the electrical stress to the insulation between the shield and the conductor, and it greatly reduces shock hazard.

Due to the fact that, in mining, the point of power usage in many cases is moving, provision must be made to attach additional lengths of cable when necessary and also to replace sections of cable which become damaged. To facilitate this and handling ease, cable is generally sectionalized in 500 to 1,000 foot lengths. Couplers must be provided between each sections and also between cable and switch gear and substations. These couplers are generally assembled at the job site by cutting and stripping cable and attaching a cable coupler to the cable ends.

The most commonly used portable cable coupler presently employed in the art has several inherent shortcomings. The usual cable couplers consist of male and female plugs and sockets, made out of dielectric materials such as glass reinforced polyester or rubber and positioned within a cast aluminum housing. The electrical connections between cable and coupler contacts have heretofore been made by first stripping both the insulation and braided shielding from each of the three phase conductors and then attaching each phase conductor to its respective male or female contact. Since the shielding around each phase conductor is terminated short of the contact in these prior coupler devices, it is necessary to provide the noted heavy insulation buildup around the unshielded conductor area of each phase conductor. After the three phase conductors have been attached to the male or female contacts, and after the heavy insulation buildup is constructed around the phase conductors, the rear of the cast housing is usually filled by pouring with an insulating compound. The compound tends to give additional insulation between the unshielded phase conductors at the rear of the housing. It also is intended to prevent moisture from entering the coupler through voids in the cable insulation.

The working environment of the mine presents severe problems, especially to electrical equipment. The mining equipment is exposed to moisture, dirt, electrically conductive dust particles, vibration, rough handling, etc. With the above described conventional cable coupler, there is an ever present danger of a serious phase-to-phase fault since the three phase conductors are unshielded within the coupler housing. This phase-to-phase type of fault is especially serious since the phase-to-phase potential, with alternating current, can be as much as 1.73 times greater than the phase-to-ground potential. The safety check systems currently employed in many mines, detect faults by continuously monitoring the electrical circuitry. If a fault is to occur, a phase-to-ground fault is preferred since it can be monitored almost instantaneously before peak voltage of that particular phase is reached and the powe automatically shut-off before serious injury or damage is caused. But this is not the case with the phase-to-phase fault, where peak voltages occur at different instants. Hence, it is desirable, from a safety standpoint, to lessen the probability of having phase-to-phase faults.

U.S. Pat. No. 3,783,434 of Ransford teaches a solution to the problems posed by phase-to-phase faults as occur within three phase, high voltage electric couplers. The Ransford coupler includes electrically shielded male and female coupling members, each such member including a like plurality of shielded phase conductors. Each phase conductor includes shielding means with a conductive layer extended from a cable shield to an electrically conductive housing whereby the shielding means is made continuous about each phase conductor as it passes through the coupler device. It is understood that the shield is maintained at ground potential, whereby electrical stress levels are lowered. However, such continuous shielding means requires an electrical connection between the noted shielding conductor and the cable shielding, as well as a connection between the shielding member and the electrical housing; the formation of such continuous shielding means requires during the assembly process detailed attention to its construction and may not be simply performed by relatively inexperienced workers.

U.S. Pat. No. 4,074,926 of Broad discloses a three-phase high voltage coupler having a first housing for supporting three male terminals and a second housing for supporting three mating female terminals, each terminal being connected to its phase conductor. The first and second housings are adapted to matingly receive each other and to be held together by a ring. Each of the phase conductors has an insulating body portion with a semiconductor linear disposed above the peripheral surface thereof. A plug member is disposed about each male terminal, and includes primary and secondary tapered surfaces, each surface being of a frusto-conical contour. A socket member is disposed about each of the female terminals and includes similar primary and secondary frusto-conically contoured surfaces for receiving those corresponding surfaces of the male, plug member. The primary tapered surfaces of the plug and socket members effect a holding action between the male and female terminals, whereas the secondary set of plug and socket tapered surfaces constitute nonlocking mating surfaces. It is apparent that such insulating body portions must be formed with a high degree of precision in order to provide the noted primary and secondary surfaces, thus increasing the cost of production of such a coupler.

U.S. Pat. Nos. 3,932,933 and 4,159,860 of Broad disclose a multiphase high voltage coupler comprised of two moisture-proof halves, one half for supporting the female connector assembly and the other half for supporting the male connector assembly. The male connector assembly has a cable termination adaptor disposed about each of its male terminals; the adaptor includes a cylindrically-shaped, front portion enclosing the male terminal. The female connector assembly has an adaptor with a corresponding front portion to be received within the front portion of the male connector assembly. A ring assembly is provided for joining the male and female connector assemblies together and operates to force in mating fashion the front portions of the male and female connector assemblies together. Further, a semiconductor layer is disposed about the rearwardly facing surface of each adaptor and interconnects with the shielding disposed about each phase conductor. In this manner, the electrostatic stress built-up due to the presence of a high voltage supplied to the phase conductor, is distributed over a semiconductor layer thereby lessening the tendency for discharge between the phase conductors.

BRIEF SUMMARY OF THE INVENTION

It is an object of this invention to provide a new and improved cable coupler assembly particularly adapted to interconnect multiphase, high voltage conductors, whereby the risk of discharge between the multiphase conductors is significantly minimized.

It is a further object of this invention to provide a high voltage coupler that is readily assembled by inexperienced labor.

It is a still further object of this invention to provide a new and improved high voltage coupler having a plurality of elements assembled and maintained in an assembled relationship that reduces the possible formation of voids between the elements and therefore the risk of ionization across the voids due to the presence of high voltages.

In accordance with these and other objects of the invention, there is provided a cable coupler for interconnecting a first plurality of plural-phase high voltage cables with a second plurality of plural-phase high voltage cables. The first plurality of cables is coupled to a like number of female terminals, whereas the second plurality of cables is connected to a like number of male terminals adapted to matingly contact the female terminals. The female terminals are adapted to be mounted within a female housing by a mounting means illustratively taking the form of a disc with openings spaced from each other to receive the female terminals. Similarly, there is included a male housing having a similar disc for mounting the male terminals in a spaced relationship with each other and in an aligned relationship with the female terminals. The mounting means and in particular the discs are comprised of a material whose conductivity is selected to be sufficiently high to establish a conductive path therethrough to a ground, whereby if a fault-producing voltage is applied to any one of the male or female terminals that a path will be readily provided from that terminal to ground, thus substantially reducing the occurrence of a phase-to-phase fault.

In a further aspect of this invention, each high voltage cable is connected to its male or female terminal, the terminal being disposed within an insulator tube having an opening for receiving the terminal and a cylindrical portion defining a recess for receiving an end of its cable. A plug member made of a resilient insulating material and having a central opening for receiving its cable, and a stress cone made of a resilient insulating material and having a central opening for receiving its cable, are disposed by a pressure plate that abuts against the stress cone and forces it under mechanical pressure against the plug member, whereby an intimate, substantially air space free-relationship is achieved between the insulator tube, the plug member, the stress cone and the terminal.

BRIEF DESCRIPTION OF THE DRAWINGS

A detailed description of a preferred embodiment of this invention is made in conjunction with the following drawings in which like reference numerals are used in the different figures for illustrating the same elements:

FIG. 6 is an enlarged cross-sectional, partial view of the matingly connected male and female connector assemblies of the high voltage cable coupler of this invention, as first shown in FIG. 2;

DESCRIPTION OF THE PREFERRED EMBODIMENT

Figures 1, 2:
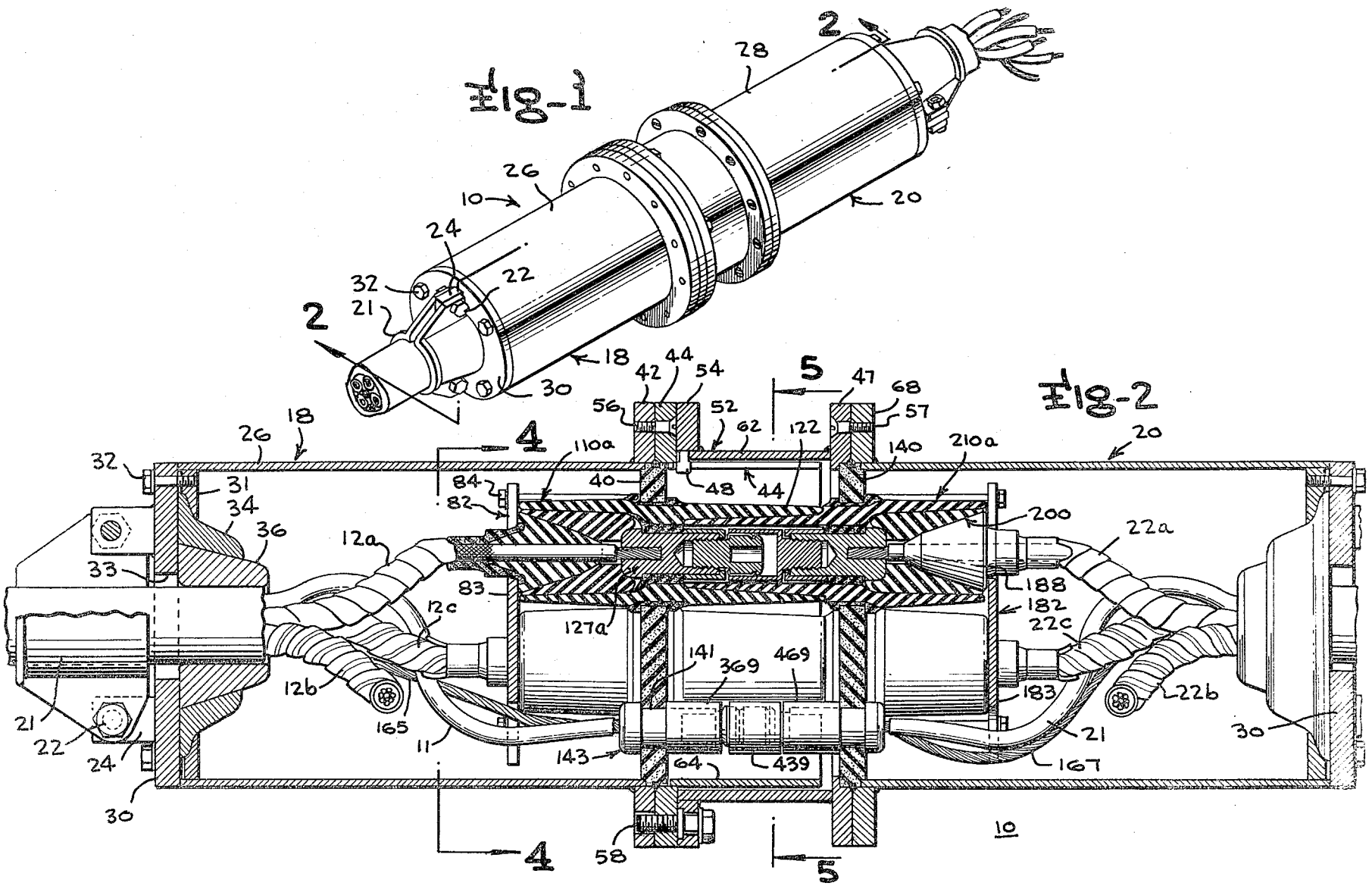
FIG. 1 is a perspective view of the male and female connector assemblies matingly assembled with each other for interconnecting the respective plural-phase high voltage cables, in accordance with teachings of this invention.
FIG. 2 is a longitudinal cross-sectional view of the male and female connector assemblies illustrating further in cross-section the male and female insulator discs, the stress cones, the plugs, the male and female insulator tubes and the pressure assemblies comprising this invention.

Referring now the drawings and in particular to FIG. 1, there is shown the female and male portions of a high voltage cable coupler 10 in accordance with the teachings of this invention for releasably interconnecting a plurality of high voltage cables together. As shown, the high voltage cable coupler 10 includes a male connector assembly 18 and a female connector assembly 20 matingly received together. The subject invention is particularly directed toward a plural or three phase cable assembly, wherein the male connector assembly 18 mounts and insulates from each other a plurality of male terminals 127*a, b* and *c* (see FIGS. 2 and 3) to be connected to corresponding of a plurality of high voltage cables 12*a, b* and *c*. In similar fashion, the female connector assembly 20 supports and mounts in insulating fashion with respect to each other a plurality of female terminals 137*a, b* and *c*, connected respectively to one of a plurality of high voltage cables 22*a, b* and *c*.

The male connector assembly 18 comprises a male cable housing 26 of substantially cylindrical configuration and made of an electrically conductive material such as stainless steel. The rearward end of the male cable housing 26 is enclosed by a cable pressure plate 30, and a retaining plate 31 (see FIG. 2) is connected by a plurality of bolts 32 to the cable pressure plate 30. The retaining plate 31 retains an annular-shaped bushing cone 34 and an inwardly disposed compression cone 36 against the cable pressure plate 30. The cable pressure plate 30 has an opening 33 therein through which each of the high voltage cables 12*a, b* and *c* pass. The compression cone 36 tightly engages the cables 12*a, b* and *c* to help relieve the axially disposed stress that would be otherwise imposed by the cables upon the male terminals 127*a, b* and *c*. As shown in FIGS. 1 and 2, stress relief is further provided by a sectioned cable clamp 21 that is disposed about the cables 12 and is secured to the cable pressure plate 30 by a pair of bolts 22 secured to lugs 24, which in turn are fixedly attached to the rearward surface of the cable pressure plate 30, transferring the force to the male cable housing 26 through the bolts 32.

Figure 3:
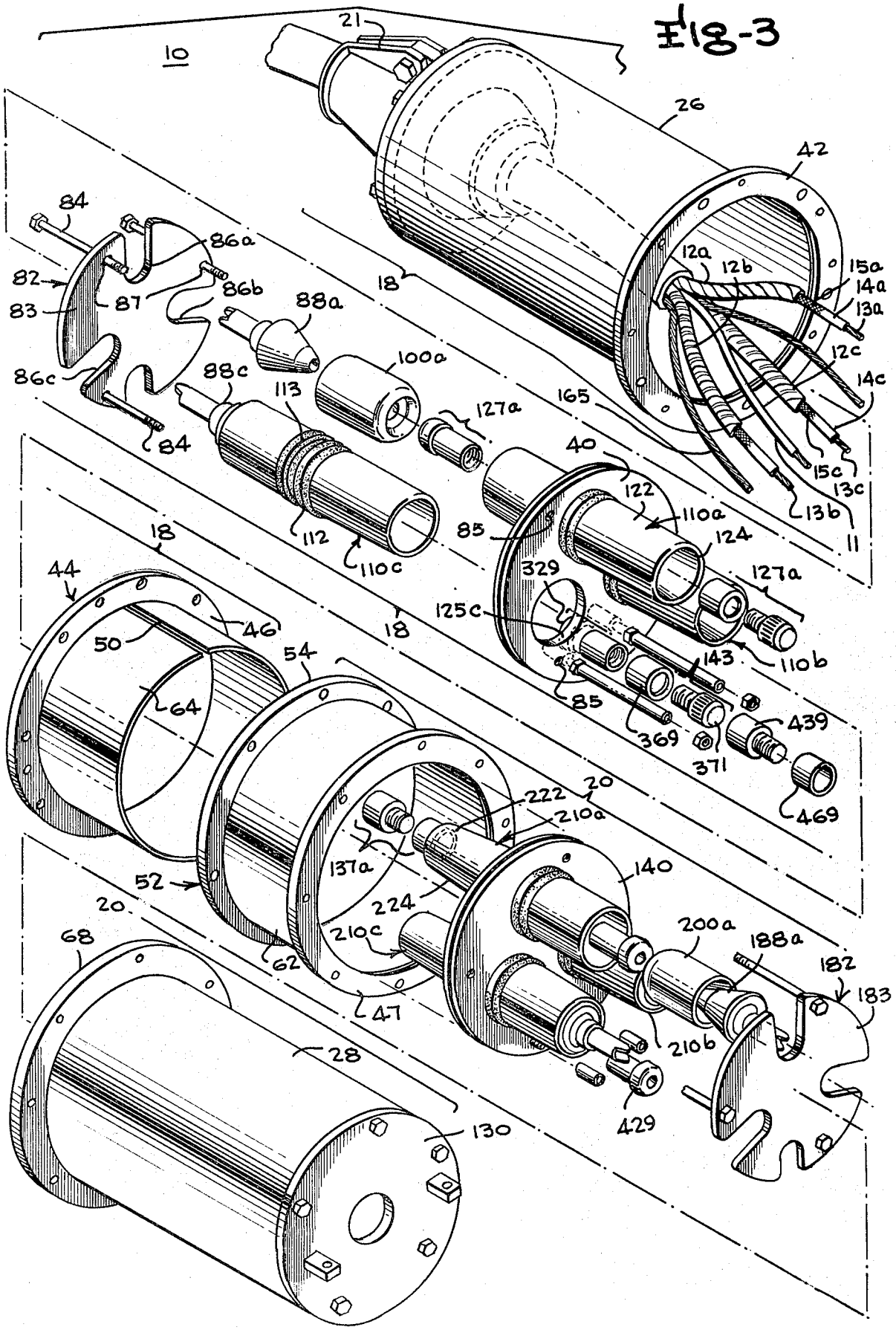
FIG. 3 is an exploded, perspective view of the male and female connector assemblies illustrating how the elements thereof are assembled.

As shown more clearly in FIGS. 2 and 3, the end of the male cable housing 26 remote from the cable pressure plate 30, is fixedly secured to an annularly-shaped housing collar 42, and to a male ground disc 40. The ground disc 40 has a plurality of terminal openings 125*a, b* and *c* for respectively receiving corresponding male terminals 127*a, b* and *c*. Each of the male terminals 127 is mounted within an annularly-shaped male insulator tube 110, there being a tube 110*a, b* and *c* for each of the terminals 127*a, b* and *c*. As clearly shown in FIG. 6, each of the tubes 110 includes an annular groove 112 defining a pair of opposing shoulders 113; the annular groove 112 is disposable within the opening 125, whereby the tube 110 is retained mounted upon the male ground disc 40 by the shoulders 113.

As seen in FIGS. 2 and 3, an annularly-shaped plug 100 is disposed about each of the high voltage cables 12 and is compressed as will be explained in detail later, against the inner peripheral surface of the tube 110 and the rearwardly facing portions of its male terminal 127. Further, a cone 88 is disposed in a compression against a rearwardly facing surface of the plug 100 and is retained thereagainst by a pressure assembly 82. As seen in FIG. 3, the pressure assembly 82 includes a pressure plate 83 having a plurality of openings 86*a, b* and *c* disposed therein for receiving the high voltage cables 12*a, b* and *c*, respectively. The pressure assembly 82 includes a plurality of plate bolts 84 that are disposed through the holes 87 and have a leading portion threadably secured to corresponding openings 85 within the male ground disc 40. Significantly, as the plate bolts 84 are threadably engaged with the male ground disc 40, the pressure plate 83 exerts a force sequentially upon the cone 88, and the male plug 100, whereby these elements are brought into intimate, force fit contact with the interior surface of the insulator tube 110 and the male terminal 127. In this manner, each of the high voltage cables 12 and its male terminal 127 is securely held within the male connector assembly 18 in a manner that substantially no air voids are created and the possibility of a discharge between these elements is reduced.

As shown in FIG. 6, the plug 100 and the cone 88 are shown in greater detail. The cone 88 is molded by standard techniques and includes a leading portion 90 made of a suitable, resilient insulating material such as an EPDM rubber, and a trailing portion 92 may have a semiconductive EPDM rubber, the trailing portion of semiconductive material serving to reduce by diverting the dielectric stresses establishes by the relatively high voltages applied to the associated cable 12. The leading portion 90 includes a first frusto-conical surface 94 and a second frusto-conical surface 96 to permit an intimate mating with corresponding surfaces of the plug 100. The cone 88 includes an abutting surface 98 against which the pressure plate 83 is pressed, as shown in FIG. 2. The trailing portion 92 extends through one of a set of openings 86 of the pressure plate 83 and serves as an extension element of the cable shield 15 of the high voltage cable 12, which is disposed through its cone opening 89. The plug 100 includes a centrally disposed aperture 102 for receiving the corresponding high voltage cable 12. The plug 100 includes a first frusto-conical surface 104 and a second frusto-conical 106 contoured to receive the corresponding surfaces 94 and 96 of the cone 88. In addition, the plug 100 includes an annular recess 108 for receiving a rearwardly disposed surface of the male terminal 127.

The male insulator tube 110 is more clearly shown in FIG. 6, as included a central opening 114 for receiving the male terminal 127 as will be explained in detail. On either side of the opening 114, there are disposed a front surface 116 and a rear surface 118 against which portions of the male terminal 127 are engaged. A rearward projecting sleeve 120 is disposed rearwardly of the male ground disc 40 and into the male cable housing 26. As shown in FIGS. 2 and 6, the sleeve 120 has a gradually sloping, inner surface 119 for receiving in intimate contact the outer peripheral surface of the plug 100. In addition, the male insulator tube 110 includes an engaging sleeve 122 disposed in the opposite direction for receiving the female terminal 137 and its insulator tube 210. As shown in FIGS. 2, 3 and 6, the engaging sleeve 122 of the male insulator tube 110 includes an inner slanted surface 124 that is designed to receive an outer surface 224 of an engaging sleeve 222 of the female insulator tube 210. The radial dimensions of the engaging sleeve 222 along the axis of the coupler 10 is slightly in excess of the corresponding axial dimension of the engaging sleeve 122, whereby upon bringing the male and female connector assemblies 18 and 20 together, a sure interference engaging fit is secured therebetween. As shown more clearly in FIG. 6, a first portion 117 of the tube 110 forming the faces 116 and 118, and the central opening 114, as well as a second portion 115 forming the annular groove 112, are made of a semiconductive EPDM rubber whereby the stresses as imposed by the high voltages placed on the associated high voltage cable 12 and male terminal 127 are evenly distributed over a relatively large surface area thereby reducing the stress level, shielding the possible stress areas and thereby diminishing the change of corona discharge.

Figure 7:
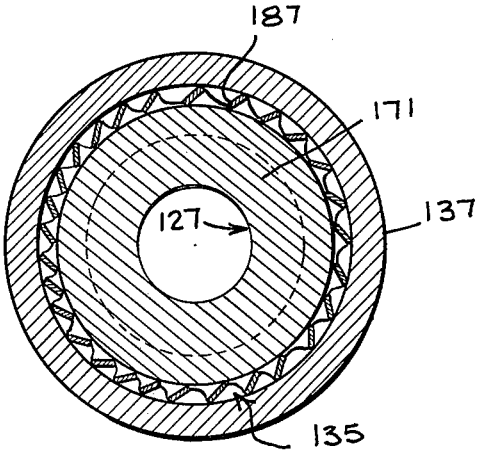
FIG. 7 is a cross-sectional end view of the matingly assembled male and female connector assemblies as taken along the plane represented by the lines 7—7 of FIG. 6.
Figure 8:
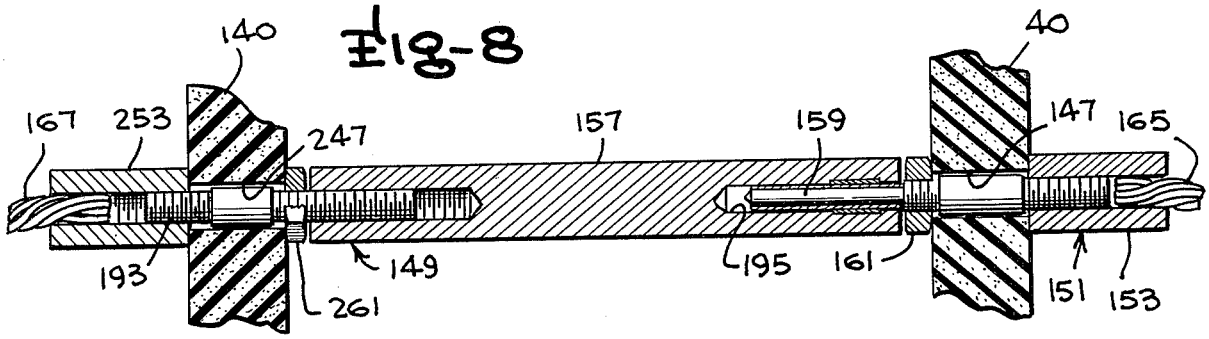

As shown in FIGS. 2 and 6, each of the male terminals 127 is formed of an assembly of elements including a terminal step 129, a terminal spacer 169 and a terminal tip 171. The terminal spacer 169 is annularly-shaped and includes an inwardly directed flange portion 123 and is dimensioned to closely fit about a peripheral, cylindrical surface 173 of the terminal stem 129. The terminal tip 171 includes a curved, leading portion 175 for permitting ready engagement with the female terminal 137, and a threaded, trailing portion 177 adapted to be screwed within a threaded recess 179 of the terminal stem 129. A conically-shaped, beveled portion 181 interconnects the trailing and leading portions 175 and 177. When the trailing portion 177 is threadably disposed within the recess 179, the beveled portion 181 is forced against the flange 123 of the terminal spacer 169, thereby fixing the thermal spacer 169 with respect to the terminal step 129. As shown in FIG. 6, the terminal stem 129 includes a flange surface 191 that is disposed against the rear face 118 of the male insulator tube 110 and the trailing edge of the terminal spacer 169 is disposed against the front face 116, when the terminal tip 171 has been threadably inserted and tightened to the terminal stem 129 thereby fixedly securing the male terminal 127 to its male insulator tube 110 and thereby to the male ground disc 40. Further, the male terminal 127 includes a multifaceted opening 185 (see FIG. 2) adapted to receive an allen wrench whereby the terminal tip 171 may be screwed into the terminal step 129. Further, an annularly-shaped contact ring 135 is disposed about the terminal tip 171 and is provided with a plurality of slits disposed along the longitudinal axis of the ring 135, whereby a plurality of tongues 187 are formed between successive slits, the tongues 187 acting as a spring-like element to ensure intimate electrical contact between the terminal tip 171 of the male terminal 127 and the female terminal 137, as shown in FIG. 7. The contact ring 135 is held in its place by means of two spring rings 180 disposed at either end and each having a slit therein.

As shown in FIG. 3, each of the high voltage cables 12*a, b* and *c* includes a centrally located conductor 13 about which is disposed a first insulating layer 14 and an outer metallic shielding layer 15, each concentrically disposed about the centrally located conductor 13. As shown in FIG. 6, each cable 12 is connected to its male terminal 129. An axial length of the metallic shielding 15 is removed to permit insertion of the insulation surface of the high voltage cable 12 through the cone 88 and the plug 100. The shielding layer 15 extends to come into physical and electrical contact with the semiconductive trailing portion 92 of the cone 88. Further, an axial length of the insulating layer 14 is removed to permit insertion of the conductor 13 into a recess 189 of the terminal stem 129, to permit the male terminal 127 to be secured to the conductor 13 by conventional means such as soldering, crimping, set screw or a cadweld operation.

A comparison of the elements that comprise the male connector assembly 18 and the female connector assembly 20 indicates that many of the parts are quite similar. Such similar parts are indicated by similar numbers with those parts relating to the male connector assembly 18 being numbered in a first series including the numeral 88 identifying the male cone, and a like part of the female connector assembly 20 being numbered with a similar number but in a second series, e.g., the cone of the female connector assembly 20 being numbered 188. For example, as shown in FIGS. 2 and 3, the female ground disc is identified by the numeral 140, the female cone 188, and the female plug 200. Each of the female terminals 137*a, b,* and *c* is connected to a corresponding one of the high voltage cables 22*a, b* and *c*, and is mounted within a corresponding one of the female insulator tubes 210*a, b* and *c*. In the manner explained above, each of the female insulator tubes 210 is disposed within an aperture 225 of the female ground disc 140. As shown in FIG. 3, the female insulator tube 210 is similar to the male insulator tube 110 differing slightly as to the position of its engaging sleeve 222. The engaging sleeve 222 of the female insulator tube 210 has an outer peripheral surface 224 that comes into contact with the slanted engaging inner surface 124 of the male insulator tube 110. As the male and female connector assemblies 18 and 20 are brought together, the engaging sleeve 122 slips over the engaging sleeve 222 of the female connector assembly 20 and the surfaces 224 and 124 are brought into intimate engagement with an interference fit.

A significant aspect of this invention resides in the use of common elements within each of the male and female connector assemblies 18 and 20, whereby these common elements may be effectively interchanged with each other. For example, as shown in FIG. 6, the female terminal 137 includes a female terminal stem 229 similar to the male terminal stem 129 and a female terminal spacer 269 similar to the male terminal spacer 169 described above. There is also included a female terminal tip 139 configured to receive the male terminal 127 and including a threaded trailing portion 277 to be threadably received within a recess 279 of the female terminal stem 229.

Figure 5:
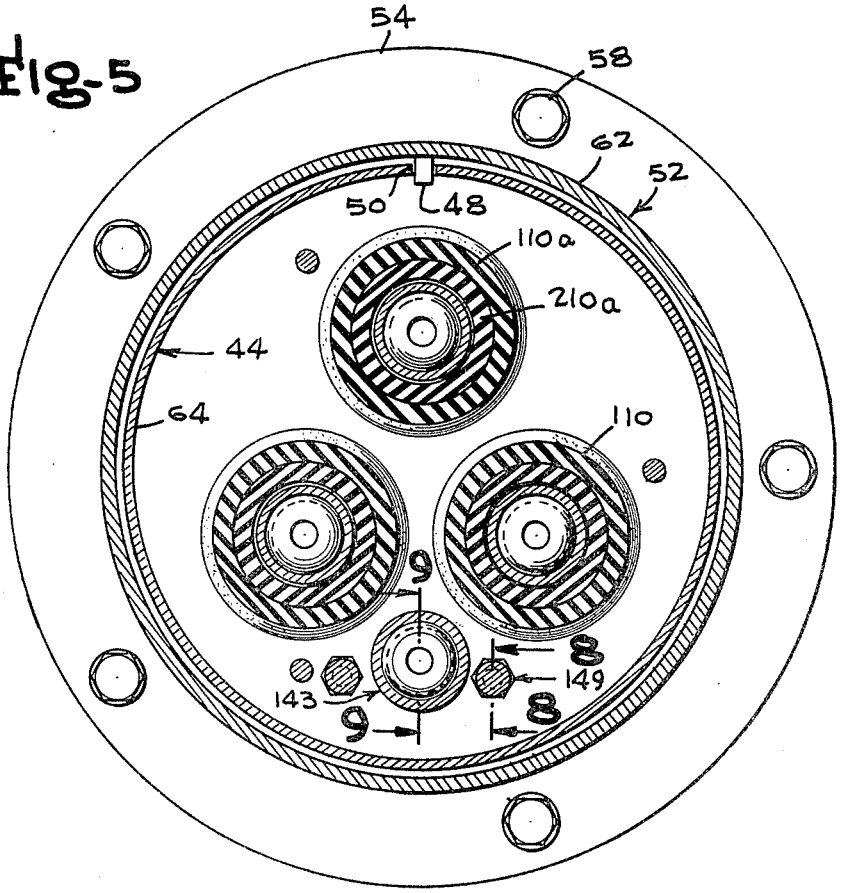
FIG. 5 is a cross-sectional view of the mating portions of the male and female connector assemblies as taken along the plane intersecting the coupler axis and as represented by lines 5—5 of FIG. 2.

As shown in FIGS. 2 and 3, the male and female connector assemblies 18 and 20 are attached to each other by an inside coupling assembly 44 and an outside coupling assembly 52. The inside coupling assembly 44 is connected to the male connector assembly 18 and includes an annularly-shaped assembly collar 46 secured to the collar 42 of the male housing 26 by a plurality of screws 56. The inside coupling assembly 44 includes also an inside tubular enclosure 64 of a cylindrical configuration having a similar diametrical dimension to that of the male housing 26. A key slot 50 is disposed therein to orient the position of the female connector assembly 20 with respect to that of the male connector assembly 18, as will be explained. The outside coupling assembly 52 includes an annularly-shaped trailing assembly collar 47 adapted to be connected to a collar 68 of the female connector assembly 20 by a plurality of screws 57. The outside coupling assembly 52 includes an outside tubular enclosure 62 of a generally cylindrical configuration which is fixedly attached at one end to the trailing assembly collar 47 by welding and at its other end, to a leading assembly collar 54 having a plurality of openings about the periphery thereof to receive bolts 58 for securing the collar 54 and its coupling assembly 52 to the assembly collar 46 and thereby to the male connector assembly 18. Further, the outside coupling assembly 52 includes a key member 48, as shown in FIGS. 2 and 5, adapted to be slideably received into the key slot 50 of the inside coupling assembly 44 to permit, as outside tubular enclosure 62 is slideably disposed about the inside tubular enclosure 64, the key member 48 to be disposed within the key slot 50 and to guide the male connector assembly 18 to first establish a mating relationship with the female connector assembly 20, before allowing the corresponding male and female terminals 127 and 137 (or the other pilot or ground terminals) to electrically and mechanically engage each other.

Figure 9:
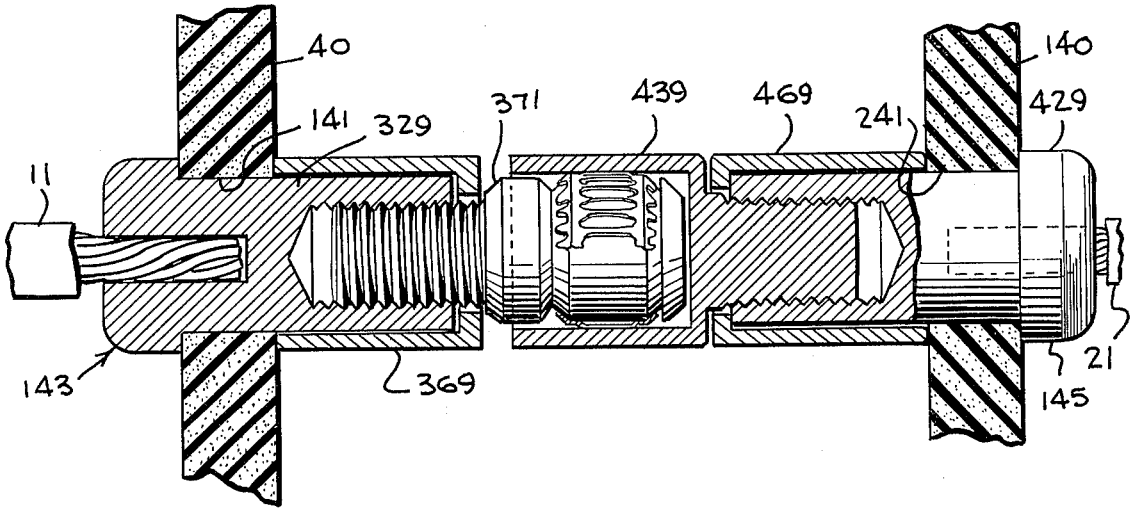
FIG. 9 is a cross-sectional, longitudinal view of the matingly connected ground male and female connector assemblies of the high voltage cable coupler of this invention, as taken along the plane represented by the lines 9—9 of FIG. 5.

As shown in FIG. 2 and FIG. 9, the high voltage cable coupler 10 is adapted to interconnect ground cables 11 and 21 via a ground male connector assembly 143 and a complimentary ground female connector assembly 145. The male ground connector assembly 143 and female ground connector assembly 145 each have an axial dimension greater than that of the male and female terminals 127 and 137, such that in mating with each other they engage before the power terminals 127 and 137 come in contact, thus assuring a ground continuity before other connections are made; in separation, the ground assemblies 143 and 145 disconnect last to maintain ground continuity until all other terminals have disconnected. It is understood that as the coupler 10 serves to interconnect the high voltage cables 12*a, b, c* respectively to the high voltage cables 22*a, b* and *c*, the coupler 10 also serves to electrically interengage the ground cables 11 and 21. The male ground disc 40 and the female ground disc 140 have corresponding openings 141 and 241 of smaller diameters than the openings 125 and 225 for receiving the connector assemblies 143 and 145. Significantly, the male and female ground discs 40 and 140 are directly connected to their ground connector assemblies 143 and 145, respectively, to ensure that the semiconductive discs 40 and 140 are connected to the ground cables 11 and 21, and therefore are disposed at ground potential. In particular, no insulator tube is inserted between the assembly 143 and the disc 40, or between the assembly 145 and the disc 140. As shown more clearly in FIG. 9, the ground male connector assembly 143 includes elements substantially similar to those of the male terminal 127 and are marked with similar numerals but in the 300 series. For example, the assembly 143 includes a terminal stem 329 adapted to be disposed through the opening 141, a terminal spacer 369 disposed about the terminal stem 329 and a terminal tip 371 adapted to be threadably received within the terminal stem 329. The ground female connector assembly 145 includes a plurality of similar elements to those of the female terminal 137 and are marked with similar numerals except in the 400 series. In particular, the assembly 145 includes a terminal stem 429 adapted to be disposed through the opening 241 of the female ground disc 140, a terminal spacer 469 adapted to be disposed about the terminal stem 429 and a female terminal tip 439 adapted to be threadably received within the terminal stem 429. The male terminal tip 371 is adapted to be electrically and mechanically disposed within the female terminal tip 439 whereby an electrical connection is established between the ground cables 11 and 21 before any other terminal connection takes place.

A significant object of this invention is to prevents faults between adjacent phase, high voltage cables 12*a, b* and *c;* rather, it is desired to direct a fault, if it occurs, from one of the phase, high voltage cables 12 to ground, i.e. through the male ground disc 40 or the female ground disc to its ground cable 11 or 21, respectively. More specifically, if the voltage carried by the cables 12 and 22 is in order of 15 Kv, the phase-to-phase fault is in the order of 15 Kv, whereas a phase-to-ground fault is in the order of 8.6 Kv. To this end, the male ground disc 40 and the female ground disc 140 are made of a material having a resistivity of 100 Ohms per centimeter or less, whereby a conductive or current path is established between each of the phase cables 12 and 22 to ground through the respective discs 40 and 140, so that phase-to-phase faults are substantially prevented. It is understood that if a high voltage fault should appear on one of the cables 12 or 22 that the fault current will be inversely proportional to the resistance presented by the current path to ground. In accordance with this invention, the current path is formed from the effected cable via the insulating disc to the corresponding ground cable thereby preventing the buildup of a voltage across the elements of the cable coupler 10 that would present a hazard to the coupler's user. Thus, if the ground disc 40 or 140 is selected to have a sufficient conductivity as defined above, the desired path to ground will be established. Thus if the volume resistivity of the ground disc 40 or 140 is selected to be equal to or less than 100 Ohms per centimeter, indicating that the material is a semiconductor or conductive material, even if 25 Kv is applied to one of the cables 12 or 22, a voltage drop across any elements of the cable coupler 10 will not harm its user and the resultant fault current will pass harmlessly through its disc 40 or 140 to the respective ground cable 11 or 21 even under damp, moist conditions as would be found in a mining environment. In an illustrative embodiment of this invention, the male and female ground disc 40 and 140 may be made of a suitable semiconductive material such as graphite processed with an ethylene propylene dyne monomer (EPDM) or polomer, or of any conductive material such as stainless steel, a mild steel with a nickel chromium plating or a non-ferrous material such as brass or aluminum. By so critically selecting the composition and thus the resistivity of the ground discs 40 and 140, the presence of a fault producing current upon one of the terminals 127 and 137, establishes a conductive path from that effected terminal through its ground disc 40 or 140 to the corresponding ground connector assembly 143 or 145.

Figure 8:
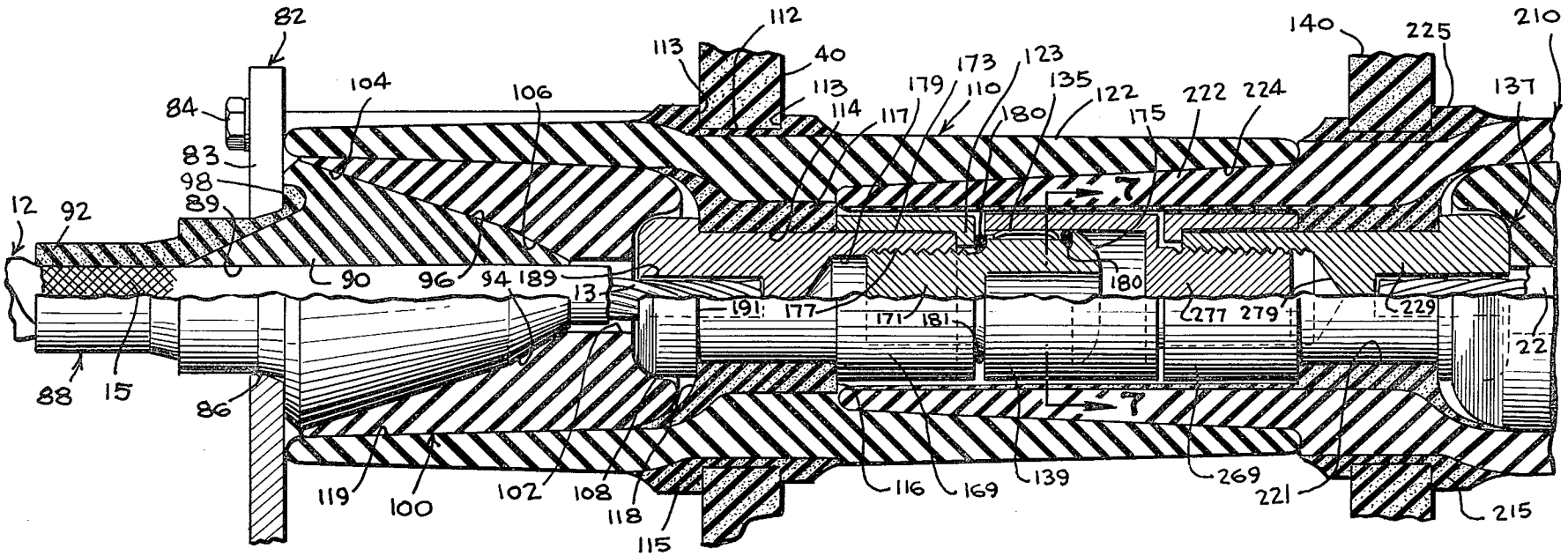
FIG. 8 is a cross-sectional longitudinal view of the matingly assembled female and male pilot assemblies of the high voltage cable coupler of this invention, as taken along the plane represented by the lines 8—8 of FIG. 5.

As seen in FIGS. 2 and 8, the high voltage cable coupler 10 also serves to interconnect pilot wire 165 and 167 whereby tests may be made to ensure the continuity or to monitor the resistivity of the cable or the ground path from a voltage source point to an utilization device, e.g. mining machinery. As more fully shown in FIG. 8, the pilot wire 167 is coupled to a female pilot assembly 149 disposed within an opening 247 of the female ground disc 140, whereas the pilot wire 165 is coupled to a male pilot assembly 151 as disposed within an opening 147 of the male ground disc 40. The female pilot assembly 149 includes a pilot pin sleeve 253 for receiving the pilot wire 167, a threaded bolt 193 threadably attached to the sleeve 253 and extending through the opening 247, a pilot nut 261 threadably disposed about the bolt 193 to secure the bolt 193 and the sleeve 253 to the disc 140, and a female pilot terminal 157 threadably secured to the bolt 193. The male pilot assembly 151 includes a pilot pin sleeve 153 similar to that of sleeve 253, a male pilot pin 147 having a trailing portion disposed through the opening 147 within the male ground disc 40 to be threadably attached to the sleeve 153, and a pilot nut 161 for securing the pin 159 to the disc 40. The male pilot pin 159 is adapted to be connected in a mating, electrical fashion to a female recess 195 of the female pilot terminal 157.

Figure 4:
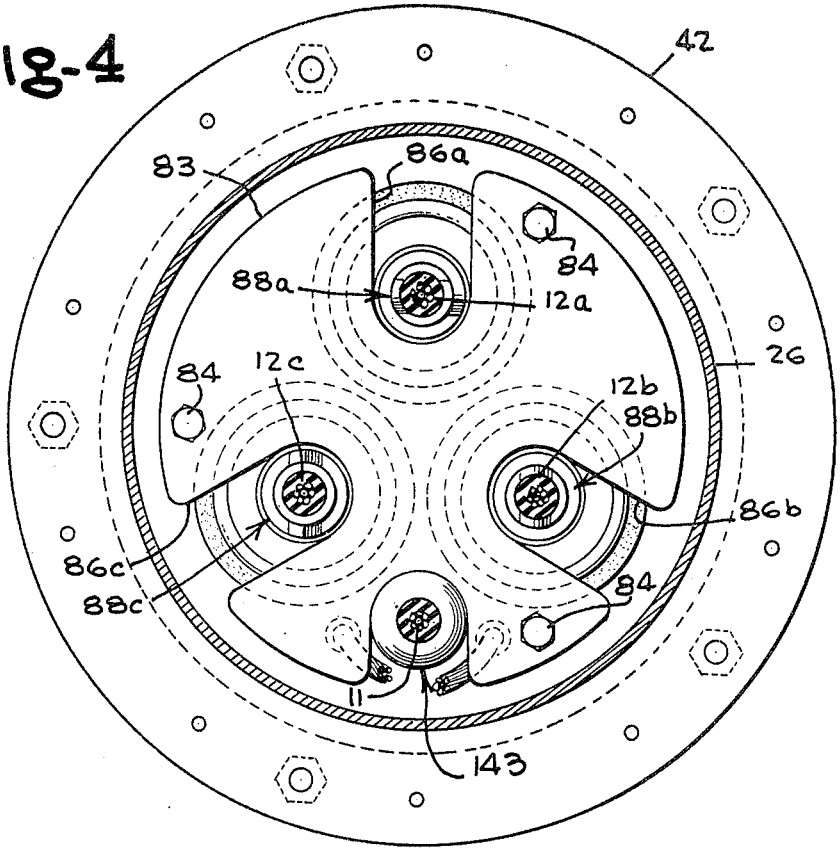
FIG. 4 is a cross-sectional view of the male cable housing of the cable coupler as taken along a plane intersecting the coupler axis and as represented by line 4—4 in FIG. 2.

A further feature of this invention relates to the close, force interfitting design of the male connector assembly 18 and the female connector assembly 20 in a manner that substantially no air spaces are formed between or about their electrically conductive or insulating parts. Such air spaces otherwise could be ionized to cause a discharge between the exposed conductive parts to which high voltages in the order of 15 to 25 Kv may be applied. Each terminal whether male or female includes its own insulator tube 110 or 210 that is disposed within an opening of its ground disc 40 or 140. As shown in FIG. 6, a second portion 115 of the male insulator tube 110 as is associated with the disc 40 and a first portion 117 of the tube 110 overlapping its centrally disposed opening 114 are made of a semiconductive material. The use of the semiconductive material as disposed in contact with male terminal 127 serves to evenly distribute the high voltage field present on the terminal 127 over a large surface area thus reducing voltage stress with respect to grounded portions of the couplder 10. As shown in FIG. 6, the stress cone 88 includes the trailing portion 92 made of a semiconductive material that functions similarly to distribute the high potential present in the cable 12 passing through the cone opening 89, over a large surface area. The cable shielding 15 is disposed about the insulating layer 14 of its cable 12 and extends to a sufficient length to be in electrical and physical contact with the trailing portion 92 of the stress cone 88, whereby a continuous shielding is provided about each of the conductors. As shown in FIGS. 2 and 4, the cone 88 and the plug 100 ar force-fitted in an axial direction toward the male terminals 127 by the pressure plate 83 by the set of plate bolts 84. Thus when the locking bolts 84 are tightened, the pressure plate 82 force-fits the plug 100 and the cone 88 into the area is defined by the tube 110 against the rearwardly projecting portion of the male terminal 127 thus assuring a tight interfit and avoiding the formation of air spaces between these elements. It is understood that the female terminal 137 includes a similar set of elements including its insulator tube 210, cone 188 and plug 200. The female insulator tube 210 includes its second portion 215 made of a semiconductive material to enclose the periphery of the opening 225 within the female ground disc 140, whereby the high voltage field is evenly distributed. For a similar purpose, a first portion of the female insulator tube 210 is disposed to receive the female terminal 137 and extends, as shown in FIG. 6, along the inner surface of the tube 210 functioning to evenly distribute the high voltage fields and to present in cooperation with that portion 117 of the male insulator tube 110, a continuous shielding about the male and female terminals 127 and 137. In addition, each of the male and female insulator tubes 110 and 210 is configured to mate with each other and their respective dimensions are selected such that the longitudinal dimension of one of the tubes 110 and 210 is slightly in excess of the axial dimension of the other. Thus when the male and female connector assemblies 18 and 20 are coupled by the coupling assemblies 44 and 52, that the tubes 110 and 210 are force-fitted with each other such that the interior 124 of the male tube 110 is in intimate contact with the outer peripheral surface 224 of the female insulator tube 210.

As shown in FIGS. 2 and 4, the pressure plate 83 associated with the male connector assembly 18 is illustratively made of stainless steel and thus is considered to provide a good conductive path if a surge potential occurs and is applied by the cables 12 to their associated stress cones 88. As shown more clearly in FIG. 6, each of the stress cones 88 includes a second trailing portion 92 made of a semiconductive material; such trailing portions 92 are disposed in intimate contact with the openings 86 formed within the pressure plate 83, whereby a path to ground is formed from the stress cones 88 through the pressure plate 83, the bolts 84 and the male ground disc 40, which as explained above is electrically connected via the ground male connector assembly 143 connected to the ground 11. In similar fashion, the pressure plate 183 associated with the female connector assembly 20 provides a similar ground path through its female ground plate 140 and its ground female connector assembly 145 to ground 21.

In an additional feature, the plug 100 and the cone 88 as disposed within the male connector assembly 18 may also be incorporated within the female connector assembly 20. Similarly, elements of the male terminal 127 may be also substituted for similar elements within the female terminal 137, thus facilitating coupler assembly.

Thus, there has been shown a plural phase cable coupler having a male and female housing each receiving and connecting plural phase cables to corresponding female and male terminals. Each of the male and female terminals are mounted within a disc made of a material having a conductivity sufficiently high to establish a conductive path to ground. In one embodiment, a ground conductor is coupled to a ground terminal mounted directly to the disc and adapted to be interconnected with the other ground terminals mounted on the opposing disc. In this manner, the possibility that a surge current may cause a breakdown between elements including the plural phase cables, is significantly reduced in that a path to ground is formed by the mounting disc of this invention. The user of the cable coupler of this invention cannot inadvertently fail to ground the coupler. In addition, the provision of the above described male and female engaging sleeves, the outside coupling assembly and the inside tubular enclosure provide an explosion-proof assembly, whereby possible discharge between the terminal elements is prevented from escaping to the ambient atmosphere surrounding this cable coupler. Still further, the use of the described pressure plate forces the dielectric or insulating elements together in a manner to avoid the formation of air spaces across which a discharge may occur. In addition, the insulating collars disposed about the terminal elements, as well as the various force-fitted insulating members are provided with surface coatings or portions made of an electrically conductive or semiconductive material, whereby the relatively high potential imposed upon these members is distributed over a larger surface thereby tending to reduce the high voltage stress and the possibility of discharge between adjacent elements. In addition, the shielding that is disposed about each of the cables is coupled to the aforementioned semiconductive portions of the insulating members whereby a continuous shielding is disposed about the conductors and the terminals to thereby tend to more evenly distribute and to reduce the high voltage stress. As evident from the above description, the outer housing of the subject cable coupler are made of a structurally strong configuration to thereby withstand possible abuse.

While specific embodiments have been illustrated and described herein, it is theorized that modifications and changes will occur to those skilled in the art. It is therefore to be understood that the appended claims are intended to cover all such modifications and changes which fall within the true spirit and scope of the invention.

I claim:

1. A cable coupler assembly for interconnecting a first plurality of plural phase, high voltage cables with a second plurality of plural phase, high voltage cables, said coupler assembly comprising:

(a) a first plurality of female terminals for attachment to corresponding of said first plurality of plural phase cables;

(b) a second plurality of male terminals for attachment to corresponding of said second plurality of plural phase cables, said male terminals being adapted to matingly contact said female terminals;

(c) a female housing including first means for mounting said first plurality of female terminals within said female housing in a spaced relationship with each other;

(d) a male housing adapted to be coupled with said female housing and including second means for mounting said second plurality of male terminals within said male housing in a spaced relationship with each other and in a manner that each of said second plurality of terminals is aligned with a corresponding one of said first plurality of terminals when said male housing is coupled to said female housing;

(e) said first and second mounting means comprised of respectively first and second support discs and first and second insulating members, said first and second support discs each including openings for respectively receiving said first and second plurality of female and male terminals, said first and second insulating members disposed respectively between each of said first and second plurality of terminals and their corresponding opening within said first and second support discs; and (f) means for disposing each of said first and second mounting means at substantially ground potential, each of said first and second mounting means comprised of a material whose resistivity is selected to be sufficiently low to establish a conductive path through its mounting means from one of said terminals to said ground disposing means if a fault producing current should be applied to said one terminal, said ground disposing means comprises first and second ground means disposed in electrical connection with said first and second support discs respectively, said first and second ground means each comprising a ground cable and a ground terminal element adapted to be matingly received by the other ground terminal, each of said ground terminals being directly connected to its supporting disc, whereby said connected support disc is established at substantially ground potential.

2. A cable coupler assembly for interconnecting a first high voltage cable to a second high voltage cable, said cable coupler assembly comprising:

(a) a male terminal and a female terminal, said male terminal adapted to matingly contact said female terminal;

(b) each of said male and female terminals having an insulator tube having a centrally disposed opening for receiving its terminal and a cylindrically-shaped portion defining a recess, a plug member made of a resilient insulating material and having a central opening through which its high voltage cable passes, and a stress cone comprised of a resilient insulating material and having a central opening through which its high voltage cable passes, said recess being configured to receive said plug member and said stess cone, a pressure plate disposed to abut its stress cone, and means for urging its pressure plate towards its terminal whereby said stress cone and said plug member are forced in a direction along its high voltage cable into intimate, substantially air-space free relationship with said recess of its insulator tube and said terminal, each of said male and female insulator tubes has a first portion presenting an exposed surface encompassing said central opening, said first portion being made of a material having sufficient conductivity to distribute the voltage stress due to the presence of high voltages on said male and female terminals over said exposed surface.

3. The cable coupler assembly as claimed in claim 2, wherein there is included male and female mounting means associated with each of said male terminals and said female terminals and comprising an opening for receiving and supporting its insulator tube, means for disposing each of said male and female mounting means at substantially ground potential, each of said male and female mounting means comprised of a material whose conductivity is selected to be sufficiently high to establish a conductive path through its mounting means from one of said terminals to said ground disposing means if a fault producing current should be applied to said one terminal.

4. The cable coupler assembly as claimed in claim 3, wherein each of said male and female insulator tubes comprises a second portion distinct from said first portion presenting an exposed surface in contact with and extending beyond the confines of said support means opening and made of a material having a conductivity to distribute relatively high voltage stresses over the exposed surface of said second area.

5. The cable coupler assembly as claimed in claim 2, wherein each of said plug members associated with said male and female terminals has a first portion of a generally cylindrical configuration to be disposed in intimate contact with said cylindrically-shaped portion of said recess, and a second portion forming a recess to receive in intimate contact a portion of its terminal.

6. The cable coupler assembly as claimed in claim 5, wherein each of said plug members has a third portion presenting a substantially concial surface and sloping inwardly from said cylindrically-shaped surface toward said central opening, and each of said stress cones having a leading, conically-shaped surface adapted to intimately fit with said conically-shaped surface of said plug member.

* * * * *